United States Patent [19]

Galiasso et al.

[11] Patent Number: 4,592,827

[45] Date of Patent: Jun. 3, 1986

[54] HYDROCONVERSION OF HEAVY CRUDES WITH HIGH METAL AND ASPHALTENE CONTENT IN THE PRESENCE OF SOLUBLE METALLIC COMPOUNDS AND WATER

[75] Inventors: Roberto Galiasso, San Antonio de Los Altos; Jose A. Salazar, Edo. Miranda; Alfredo Morales, San Antonio de Los Altos; Angel R. Carrasquel, Edo. Miranda, all of Venezuela

[73] Assignee: Intevep, S.A., Caracas, Venezuela

[21] Appl. No.: 748,493

[22] Filed: Jun. 25, 1985

Related U.S. Application Data

[63] Continuation-in-part of Ser. No. 461,891, Jan. 28, 1983, abandoned.

[51] Int. Cl.[4] ..... C10G 47/04; C10G 65/10; C10G 65/12; C10G 67/04

[52] U.S. Cl. ..... 208/59; 208/96; 208/97; 208/112; 208/210; 208/216 R; 208/217; 208/251 H

[58] Field of Search ..... 208/57, 59, 96, 97, 208/112, 61, 210, 212, 216 R, 217, 251 H

[56] References Cited

U.S. PATENT DOCUMENTS

| | | | |
|---|---|---|---|
| 3,331,769 | 7/1967 | Gatsis | 208/210 |
| 3,353,920 | 11/1967 | Kitzen | 208/130 |
| 3,471,398 | 10/1969 | Borst, Jr. | 208/111 |
| 3,841,996 | 10/1974 | Jacobsen | 208/112 |
| 3,859,199 | 1/1975 | Gatsis | 208/97 |
| 3,905,892 | 9/1975 | Gregoli et al. | 208/95 |
| 4,125,455 | 11/1978 | Herbstman | 208/108 |
| 4,216,077 | 8/1980 | Chahvekilian et al. | 208/57 |
| 4,247,387 | 1/1981 | Akbar | 208/106 |
| 4,272,357 | 6/1981 | Rollmann | 208/89 |
| 4,285,804 | 8/1981 | Jacquin et al. | 208/48 R |
| 4,389,301 | 6/1983 | Dahlberg et al. | 208/59 |
| 4,431,520 | 2/1984 | Giuliani et al. | 208/112 |
| 4,435,277 | 3/1984 | Dinh et al. | 208/108 |
| 4,468,316 | 8/1984 | Swanson | 208/59 |
| 4,473,462 | 9/1984 | Swanson | 208/59 |
| 4,557,821 | 12/1981 | Lopez | 208/108 |

*Primary Examiner*—John Doll
*Assistant Examiner*—O. Chaudhuri
*Attorney, Agent, or Firm*—Baker & McKenzie

[57] ABSTRACT

Heavy crudes or vacuum residues are treated in a thermal hydroconversion process in the presence of a metal catalyst from Groups IVb, Vb, VIb, VIIb and VIII of the Periodic Table of Elements and water. Fresh catalyst is introduced into the process as a soluble, metallic catalyst precursor which is then decomposed while feedstock admixed with water is preheated to a temperature of at least about 230° C. but no more than about 420° C.

18 Claims, 5 Drawing Figures

THERMOGRAVIMETRIC ANALYSES OF PRECURSOR ORGANOMETALLIC COMPOUNDS

HYDROCONVERSION OF HEAVY CRUDES WITH HIGH METAL AND ASPHALTENE CONTENT IN THE PRESENCE OF SOLUBLE METALLIC COMPOUNDS AND WATER

CROSS-REFERNECE TO RELATED APPLICATION

This application is a continuation-in-part of our copending patent application Ser. No. 06/461,891, filed on Jan. 28, 1983, now abandoned.

INTRODUCTION

Large deposits of heavy and extra heavy crudes exist worldwide. However, these crudes have a high viscosity, large concentrations of metals and sulfur and low yields in liquids, so that they are of little interest to world markets. This has led to new processing methods which permit the improvement of these crudes by increasing the quality and quantity of liquid yields at the lowest possible cost. Numerous methods exist which produce synthetic crudes and finished products by using one or more stages of conversion or by catalytic or thermal steps. The principal inconvenience of the methods which include a thermal step, such as hydrocracking, is the formation of coke. Different methods have been used to avoid it. For example:

U.S. Pat. No. 2,091,831 discloses a thermal cracking method carried out in the presence of organic acid salts soluble in the crude, selected from carboxylic acid with metals from groups VI and VIII.

U.S. Pat. No. 3,131,142 discloses a slurry hydrocracking method wherein a compound soluble in the crude feedstock, selected from groups IV and VIII, is added in quantities ranging between 0.1 and 1% by weight.

U.S. Pat. No. 3,161,585 discloses a method of hydrorefining which treats a crude feedstock with a finely dispersed catalyst containing metals from Groups Vb and VIb of the Periodic Table. The concentration of the catalyst used is specified as varying between 0.1 and 10% by weight (as elemental metal).

U.S. Pat. No. 3,331,769 discloses a method for hydrorefining petroleum crude oil utilizing a fixed bed reaction zone. This patent also discusses briefly liquid-phase hydrogenation using a slurry of sub-divided catalysts, but points out that this type of process is relatively ineffective with respect to oil-insoluble asphaltenes.

U.S. Pat. No. 3,663,434 describes a method for the hydrodesulfurization of a heavy crude comprising two hydrotreatment stages, the first step of which is carried out in a fixed catalyst bed at high temperatures (400°–490° F.) in the presence of hydrogen, producing an increasing hydrogenation activity along the bed. In the second step, a portion of the liquid effluent from the first bed then passes across a second catalyst bed containing hydrodesulfurization catalyst particles at 500°–900° F.

U.S. Pat. No. 3,779,897 describes a method for the hydrodesulfurization and hydrodenitrogenation of hydrocarbons with boiling ranges between 400° and 1000° F. comprising two stages: a hydrotreatment, followed by a hydrocracking of the liquid effluent at pressures ranging between 1,200 and 1,500 psi.

U.S. Pat. No. 4,092,238 discloses the hydroconversion of a residual oil obtained from the division of the crude into different effluents. At least the medium fraction is subjected to hydrocracking, after which a recombination of the hydrocracked product with the other currents produces a crude with low density and low sulfur content.

U.S. Pat. Nos. 4,134,825 and 4,192,735, assigned to Exxon Research Engineering Co., disclose a process for the catalytic hydroconversion and hydrocracking of heavy crudes which is effected by adding to the feedstock a soluble metallic compound in quantities of 10 to 950 ppm, calculated as elemental metal. The metal therein is selected from the following groups of the Periodic Table: IVb, Vb, VIb, VIIb and VIII, with molybdenum naphthenate being the preferred compound.

U.S. Pat. No. 4,233,138 discloses a method in which a visbreaking of the feed is carried out in the presence of inorganic sulfides in order to eliminate the formation of coke.

SUMMARY OF THE INVENTION

This invention provides for the processing of heavy crudes or residues thereof by a combination of methods and additives not disclosed in the prior art. In particular, a heavy crude or a vacuum residue thereof is treated in a thermal hydroconversion process at elevated temperatures in the presence of water. Fresh hydroconversion catalyst is added to the process as the soluble, decomposable metallic compound. Conversion of a 500° C.+ vacuum residuum can be readily effected.

Thereafter, different hydrocarbon fractions are separated by distillation; the relatively lighter fractions can be passed to either a hydrorefining stage or combined directly to form a synthetic crude. A portion of the residue is recycled to extinction and the remainder of the residue is passed to a deasphalting stage from which the deasphalted product is subjected to hydrotreating. Alternatively, the deasphalted product can be used as part of a fuel oil for field use. Precipitated asphaltenes from the deasphalting stage are partially oxidized, and metallic catalyst is recovered from the resulting ashes and recycled.

More particularly, the present thermal hydroconversion process contemplates combining a hydrocarbon feedstock with water, a metallic catalyst precursor, and a liquid recycle stream containing metallic catalyst, and then pre-heating the resulting liquid admixture in the presence of water to a temperature of at least about 230° C. but no more than about 420° C. to decompose the catalyst precursor and provide a metal catalyst for hydroconversion.

Thereafter hydrogen is introduced into the preheated, water-containing admixture, and the resulting mixture is subjected to thermal hydroconversion at a temperature of about 420° C. to about 540° C. and at a pressure of about 20 to about 250 atmospheres for a time period sufficient to produce an upgraded hydrocarbon mixture. The hydroconversion can be carried out in a single step or in plural steps, as desired. If desired, additional water can be introduced into the hydroconversion reactor, e.g., by steam injection.

Next, the upgraded hydrocarbon mixture is fractionated to produce at least one vapor phase hydrocarbon fraction and a residue fraction containing the metal catalyst. A portion of the residue fraction is recycled and combined with the incoming hydrocarbon feedstock prior to pre-heating as described above. The remainder of the residue fraction can be subjected to deasphalting, if desired, or otherwise utilized.

The presence of substantial amounts of water in the liquid admixture to be pre-heated beneficially influences the subsequent thermal hydroconversion of the feedstock and also minimizes coke formation. To that end, liquid water is added to the incoming feedstock in an amount of about 0.1 to about 20 volume percent, based on the incoming feedstock and is present in the preheated liquid admixture that is subjected to hydroconversion in an amount of about 2 to about 25 volume percent, based on the incoming feedstock, preferably in an amount of about 5 to about 20 volume percent, and most preferably in an amount of about 10 to about 20 volume percent.

The metallic catalyst precursor is soluble in the feedstock and contains a metallic catalyst which is a member of the group consisting of Groups IVB, VB, VIB, VIIB and VIII of the Periodic Table of Elements as described in *Handbook of Chemistry and Physics,* 54th edition, CRC Press, Cleveland, Ohio 44128, U.S.A. The amount of the catalyst precursor combined with the incoming feedstock is such as to provide about 50 to about 1000 parts of metal catalyst per million parts by weight of the feedstock.

The liquid recycle stream contains the metal catalyst in an amount of about 400 to about 15,000 parts of metal catalyst per million parts by weight of the recycle stream, and preferably is combined with the incoming hydrocarbon feedstock in an amount constituting about 0.1 to about 20 volume percent of the hydrocarbon feedstock. More preferably, the liquid recycle stream is combined in an amount of about 5 to about 15 volume percent of the hydrocarbon feedstock.

DETAILED DESCRIPTION OF PREFERRED EMBODIMENTS AND EXAMPLES

Figure 1:
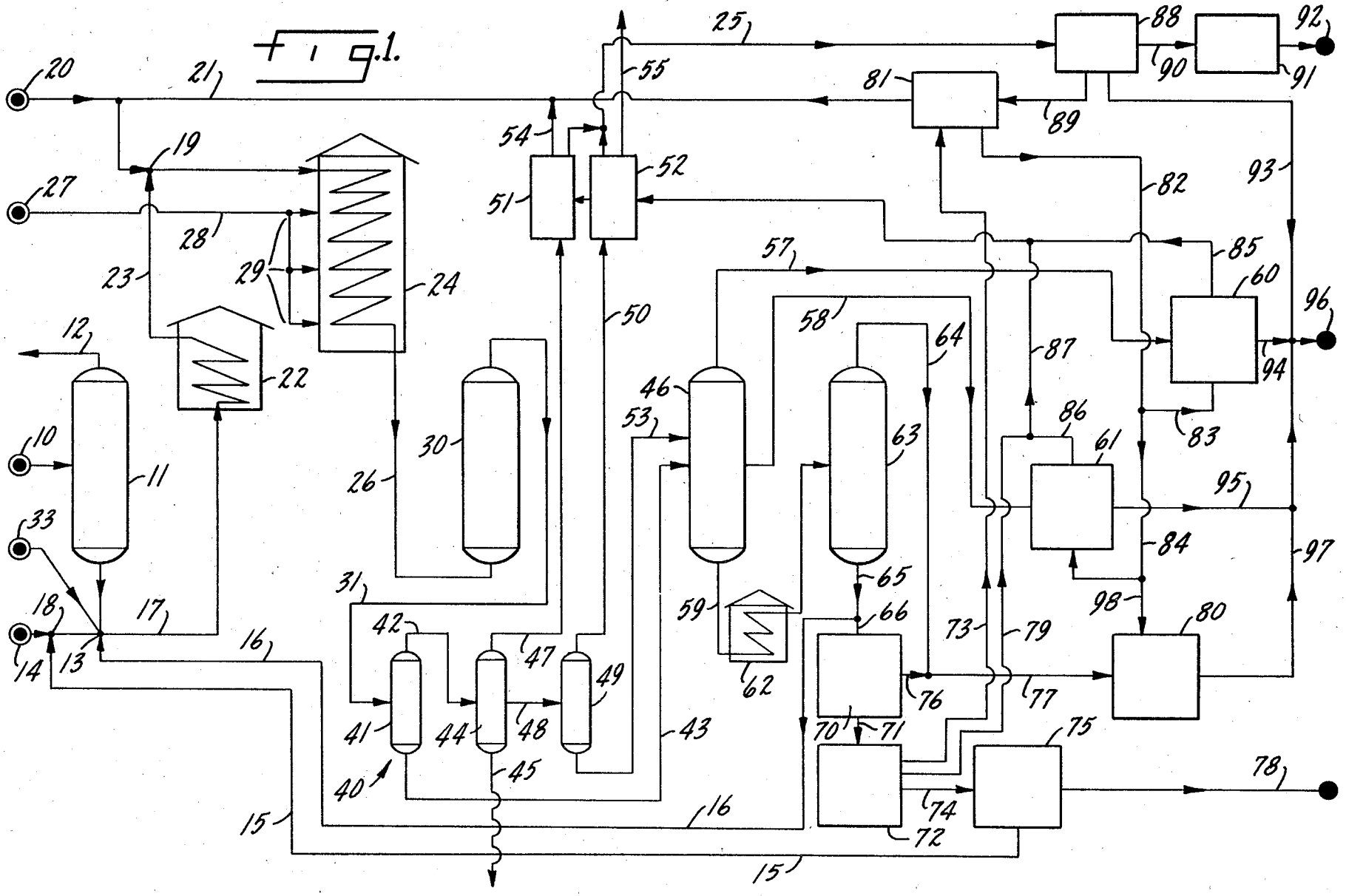
FIG. 1 shows a simplified schematic diagram of a preferred process embodiment of the invention, with conventional elements such as pumps, compressors and heat exchangers omitted for clarity.

In the process of the present invention, as shown in FIG. 1, hydrocarbon feedstock 10, which can be a heavy crude and/or its atmospheric or vacuum residue having high metals and asphaltene content, is subjected to distillation in unit 11 from which distilled oil with an end boiling point ranging from about 200° to about 510° C. is drawn off via line 12. After distillation, a metallic catalyst precursor compound soluble in the feedstock is injected into the process stream at point 13. The metallic catalyst can be derived from several sources: fresh catalyst 14, preferably a hydrocarbon-soluble molybdenum compound such as molybdenum acetylacetonate or molybdenum naphthenate, a catalyst 15 recovered from a later step of the invention added at point 18, or an active catalyst present in a vacuum residue recycled to the beginning of the process via conduit 16.

The metallic catalyst precursor can be added in an amount sufficient to provide concentrations of fresh catalyst of about 50 to about 1000 ppm by weight with respect to the feed, preferably in concentrations of about 50 to about 200 ppm by weight. The recycled active metal catalyst is injected into the feed at point 13 in concentrations in the range of about 400 to about 15,000 ppm by weight with respect to the recycled vacuum residue. Although molybdenum is the preferred metallic catalyst, any soluble metallic compound whose metal component is a metal of Group IVb, Vb, VIb, VIIb or VIII of the Periodic Table, and which compound is decomposable at the reaction conditions, may be advantageously used in the process of the invention. Recycled vacuum residue stream 16 is added to the hydrocarbon feedstock in an amount of about 0.1 to about 20 percent by volume with respect to the hydrocarbon feedstock, preferably in an amount of about 5 to about 15 percent by volume.

Water from source 33 is also injected into the hydrocarbon stream at point 13 in order to favorably alter the metallic compound-sulfur molecular equilibrium. Water is injected to provide and maintain a liquid water concentration during hydroconversion in the range of about 2 to about 25 percent by volume, preferably about 5 to about 20 percent by volume, and most preferably about 10 to about 20 percent by volume. Most, and in some instances all, of the water introduced into the admixture to be subjected to hydroconversion conditions is added at the preheating stage, usually in an amount of about 0.1 to about 20 percent by volume of the incoming feedstock. The remainder of the desired amount of water is added by steam injection into the hydroconversion reactor. In any event, a substantial amount of water is present in the admixture that is preheated, and a substantial amount of water is present during hydroconversion.

The resulting hydrocarbon and water admixture is then fed into a preheating zone 22 where it is heated to a temperature of at least about 230° C. but no more than about 420° C. to effect decomposition of the metallic catalyst precursor. The pre-heated admixture exits via line 23.

Hydrogen is next injected into the hydrocarbon stream at point 19. The hydrogen may be derived from a fresh hydrogen supply 20 or from a combination of the fresh supply and recycled hydrogen stream 21. The feed ratio of hydrogen-to-hydrocarbon may be in the range of about 100 to about 2000 $m^3(STP)/m^3$, and preferably is in the range of about 300 to about 1500 $m^3(STP)/m^3$.

The produced mixture next proceeds to helicoidal reactor 24. Additional water from source 27 may be locally injected as steam via line 28 at multiple points 29 along reactor 24 in volumetric ratios of about 0 to about 1 $m^3$ of water per $m^3$ of hydrocarbon feed, to further minimize coke formation, and to maintain a desired temperature differential ($\Delta T$). The quality of the products can be further improved as a result. Inside the reactor, the produced reaction mixture may proceed in an ascending or a descending direction. A descending direction is preferred, however.

The liquid hourly space velocity inside the reactor can vary in a range of about 0.5 to about 20 $hours^{-1}$ and the volumetric hydrogen-to-hydrocarbon ratio can be about 500 to about 2,500. The operating hydrogen partial pressure can vary in the range of about 20 to about 250 atmospheres, preferably about 50 to about 150 atmospheres. The temperature within the reactor is increased gradually such that, starting out from about 230° C., there will be maintained an average logarithmic ΔT of about 30° to about 150° C. between the liquid reactants and the reactor wall until the liquid reactants reach a temperature of about 400° to about 420° C. Substantially no visbreaking occurs during this preheating stage as will be discussed in greater detail hereinbelow.

The temperature is then maintained at a plateau of about 420° to about 540° C., preferably in the range of about 440° to about 500° C. The rate of heat transfer in the reactor varies in the range of about 350 to about 10,000 Kcal/(h)($m^2$) due to the gradual temperature increase.

At least a portion of the metallic precursor compounds injected into the feedstock turn into active catalysts upon heating within the helicoidal reactor temperature. These active catalysts operate to convert residual material while minimizing coke formation.

The objective of the helicoidal reactor stage is to start a conversion reaction and to obtain a partial conversion of the 500° C.+ fraction. The degree of conversion usually ranges from about 10 to about 40 weight percent, based on the 500+° C. residuum initially contained in the feedstock. Preferably, this partial conversion level is maintained in a range of about 20 to about 30 weight percent.

The partially converted hydrocarbon feed then passes via conduit 26 to an ascending-flow tubular bubble-column "soaker" reactor 30 and passes therethrough at a liquid hourly space velocity of about 0.5 to about 5 $hours^{-1}$. The operating temperature can be in the range of about 420° and 540° C., and preferably is about 430° to about 460° C., so as to be substantially less than the maximum operating temperature of helicoidal reactor 24. This temperature in the tubular reactor can be maintained without external heating. The pressure in the tubular reactor is substantially the same as that found in the helicoidal reactor (i.e., about 20 to about 200 atmospheres; preferably about 50 to about 150 atmospheres).

The treated hydrocarbon stream then exits the tubular reactor 30 via conduit 31 and proceeds to an oil separation stage indicated generally at 40. The oil separation stage is designed to remove water and gases from the liquid hydrocarbon stream. First oil separator 41 produces a light fraction 42 (normally boiling below 200° C.) and a heavy fraction 43 which contains the catalyst and is substantially free of naphthas. The light fraction 42 is fed to a second oil separator 44, and the heavy fraction 43 proceeds directly to an atmospheric distillation column 46. The second oil separator 44 produces a fraction 47 containing hydrogen-rich gas, water stream 45 and a liquid hydrocarbon fraction 48, the last of which proceeds to third oil separator 49. In third oil separator 49 an additional fraction 50 is separated, consisting mainly of $C_1$–$C_4$, normally gaseous, hydrocarbons.

Hydrogen fraction 47 is fed to $H_2$ gas stripping unit 51 while the $C_1$–$C_4$ fraction 50 is fed to gas stripping unit 52, which in turn produces a cleaned $C_1$–$C_4$ fraction 55 and hydrogen sulfide ($H_2S$). Gas stripping unit 51 produces hydrogen stream 54 suitable for recycling to the beginning of the process and $H_2S$, which stream, together with $H_2S$ stream from unit 52 proceed via conduit 25 to sulfur recovery processing stage 88. The liquid hydrocarbon from oil separator 49 is fed through conduit 53 to atmospheric distillation column 46.

Atmospheric distillation column 46 produces a naphtha fraction 57, a gas oil fraction 58, and an atmospheric residue 59. Naphtha fraction 57 proceeds to a conventional naphtha hydrotreatment stage 60. Gas oil fraction 58 likewise is sent to a conventional gas oil hydrotreatment stage 61. Atmospheric residue 59 passes through a preheater 62 on its way to a vacuum distillation tower 63.

Vacuum distillation tower 63 produces a vacuum gas oil 64 and a vacuum residue (500° C.+) 65. A portion of the vacuum residue 65, which contains a relatively high concentration of active catalyst, is sent back via conduit 16 to join hydrocarbon feedstock 17 in order to be recycled to its extinction. In an alternate embodiment, conduit 16 is joined to conduit 26 so that the active catalyst can enter the hydrocarbon process stream at a point after the helicoidal reactor 24.

The remainder of the vacuum residue proceeds via conduit 66 to a solvent deasphalting unit 70. The unit may operate at pressures in the range of about 14 to about 50 atmospheres and at temperatures in the range of about 100° to about 170° C. Preferably the deasphalting unit operates at a pressure of about 20 to about 30 atmospheres and at a temperature of about 120° to about 150° C. The deasphalting solvent can be a hydrocarbon or a mixture of hydrocarbons in the $C_5$ to $C_8$ range. Preferably, the solvent is a hydrocarbon in the $C_5$ to $C_7$ range. The asphaltenes present are withdrawn in the presence of water and, preferably an aromatic gas oil, and sent via conduit 71 to partial oxidation stage 72 which, in turn, produces $H_2$ exiting via conduit 73, sulfurous gases exiting via conduit 79 and/or heat energy. Ashes from the burned asphaltenes, containing vanadium, nickel, iron, sodium and molybdenum, are fed via path 74 to metals recovery stage 75.

Stage 75 digests the ashes by heating them in sulfuric acid. At least a portion of the molybdenum or other reactive metal is recovered by means of an ammoniacal solution, and is then chemically converted into a catalyst precursor, i.e., a metallic compound such as molybdenum acetylacetonate, or the like. The recovered metallic compound is sent via recovered catalyst stream 15 to make up a portion of the fresh catalyst precursor at 18, which is also injected into the hydrocarbon feedstock at point 13. The remaining metals are recovered as a by-product and exit via pathway 78.

Deasphalted oil 76 from deasphaltation unit 70 may be separated by distillation into predetermined cuts, may be treated in a separate hydrotreatment stage, or, as shown in FIG. 1, may be combined with vacuum gas oil 64 to proceed via conduit 77 to hydrotreatment stage 80. Naphtha hydrotreatment stage 60 and gas oil hydrotreatment stage 61 are both of the descending-flow, fixed-bed type and employ hydrogenation catalysts to hydrodesulfurize and hydrodenitrogenize the subjected feed. Make-up hydrogen is fed from hydrogen reformation stage 81 through conduit 82 which, in turn, branches into conduits 83 and 84 to feed hydrotreatment stages 60, 61 and 80. $H_2S$ evolved in hydrotreatment stages 60 and 61 leaves via conduits 85 and 86, which join sulfurous gas conduit 79 to form conduit 87. The sulfurous gases in conduit 87, after having $H_2$ and $C_1$–$C_4$ hydrocarbon stripped from them by units 51 and 52, proceed via conduit 25 to sulfur recovery processing stage 88. This stage produces a small quantity of hydrogen which proceeds via conduit 89 to hydrogen reformation unit 81, sulfur which proceeds via conduit 90 to sulfur recovery unit 91 and thence to sulfur end product path 92, and $C_1$–$C_4$ hydrocarbons, which exit via conduit 93.

The hydrotreated naphtha and gas oil exit via conduits 94 and 95, where they join with conduit 93 to form at least in part, a high-quality synthetic crude 96.

The vacuum gas oil and/or deasphalted oil hydrotreatment stage 80 is unconventional. This stage may comprise one or more beds of hydrogenation and hydrodemetallization-hydrodesulfurization catalyst which has the characteristics set forth in Table 1.

TABLE 1

| Catalyst for Vacuum Gas Oil and/or Deasphalted Oil Hydrotreatment Stage | | |
|---|---|---|
| Properties | Specified Ranges | Preferred Ranges |
| $MoO_3$, wt % | 0–20 | 5–15 |
| $WO_3$, wt % | 0–20 | 5–10 |
| NiO, wt % | 0–8 | 1–6 |
| CoO, wt % | 0–8 | 2–6 |
| $SiO_2$ and $Al_2O_3$, wt % | complement | complement |
| pellet size, inches | 1/32–1/4 | 1/32–1/16 |
| Area, BET, $m^2/g$ | 50–300 | 150–300 |
| pore volume, cc/g | 0.6–1.4 | 0.6–1.2 |
| average pore diameter, A | 80–400 | 110–200 |
| apparent density, g/cc | 0.6–1.5 | 0.8–1.4 |
| real density, g/cc | 2.7 | 4.0–6.4 |
| Bed density, g/cc | 0.4–0.9 | 0.54–0.8 |
| bulk crushing strength of pellets, kg/pellet[1] | 2–6 | 2.4–5.0 |
| Distribution of pores, % $V_p$ | | |
| Pore Diameter, A | | |
| 20–30 | 0–40 | 0–20 |
| 30–60 | 0–40 | 0–20 |
| 60–90 | 0–50 | 5–40 |
| 90–150 | 0–50 | 10–40 |
| 150–300 | 0–40 | 0–35 |
| 300–$10^3$ | 0–40 | 0–20 |
| $>10^3$ | 0–40 | 5–35 |

[1]Measured along the longitudinal axis of the pellet.

These catalysts are prepared by successive impregnations of refractory supports with Group VIb and Group VIII metallic compounds. The refractory supports are macroporous and in which more than 40% of pore radii are larger than 100 A. To prepare such catalysts, a soluble salt of Group VIb metal is first contacted with the macroporous refractory support over a time period of about 0 to about 24 hours, preferably over a time period of about 1 to about 5 hours. The resulting impregnated support is dried at a temperature of about 80° to about 120° C. and thereafter calcined at about 400°–600° C. (preferably about 450°–550° C.). This calcined catalyst is then contacted with a solution of one or more compounds containing metals of Group VIII over a time period of about 0.2 to about 5 hours, preferably about 0.5 to about 3 hours and dried at about 80°–120° C. The dried catalyst is activated by calcining at a temperature of about 400° to about 600° C. (preferably about 450°–550° C.). The activated catalyst is treated with steam at about 600° C. and presulfurized in the presence of carbon disulfide and hydrogen at a temperature of about 230° and 350° C.

In instances where two or more catalytic beds are used, the catalytic beds may be arranged in the same reactor or in separate reactors in series, and in such a way that a homogeneous deposition of metals will be obtained along the hydrotreatment reactor. In hydrotreatment unit 80, the hydrocarbon and hydrogen feed preferably follows a descending path along a first and then along a second catalytic bed.

The operating pressure of hydrotreatment stage 80 can vary in the range of about 20 and 200 atmospheres, preferably about 50–150 atmospheres. The temperature can vary in the range of about 350° to about 440° C., and preferably about 350°–430° C. The hydrogen:hydrocarbon ratio can vary in the range of about 100 to about 2,000 $m^3(STP)/m^3$, preferably about 300 to about 1,500 $m^3(STP)/m^3$. In both the first and second catalytic beds, the hydrocarbon and the hydrogen react in such a manner that the ratio of final temperature to initial temperature, measured in °C., is less than 1.2. The liquid hourly space velocity in the hydrotreatment stage can vary in the range of about 0.2 to about 5.0 $h^{-1}$, preferably about 0.5 to about 4.0 $h^{-1}$.

The vacuum gas oil/deasphalted oil hydrotreatment stage 80 of the invention is not limited to either one or two hydrotreatment reactors, or one or two catalysts. The hydrotreatment stage may utilize one or more catalysts and one or more reactors, as desired, to produce products of desired specifications within the required operating time.

After hydrotreatment, the vacuum gas oil and/or deasphalted oil exits via conduit 97 either to form a portion of syncrude 96 or to proceed to further processing.

It has been found that under these particular conditions, an adequate conversion of high metal and asphaltene-content heavy crudes into products of high quality is obtained, with a minimum formation of gases and coke, with a maximum yield in volume of liquids, and with an adequate processing time and minimum energy consumption.

The examples below further illustrate the present invention but are not intended as limiting.

EXAMPLE 1

Demonstration of the Suppressive Effect of Soluble Metallic Compounds on Coke Formation A whole Morichal Crude was heated in an autoclave with a capacity of 2.5 liters, with and without the presence of soluble metallic catalyst precursor compounds. The experimental conditions were:

Temperature=420° C.

Pressure=1800 psi

Residence time=60 minutes.

Figure 2:
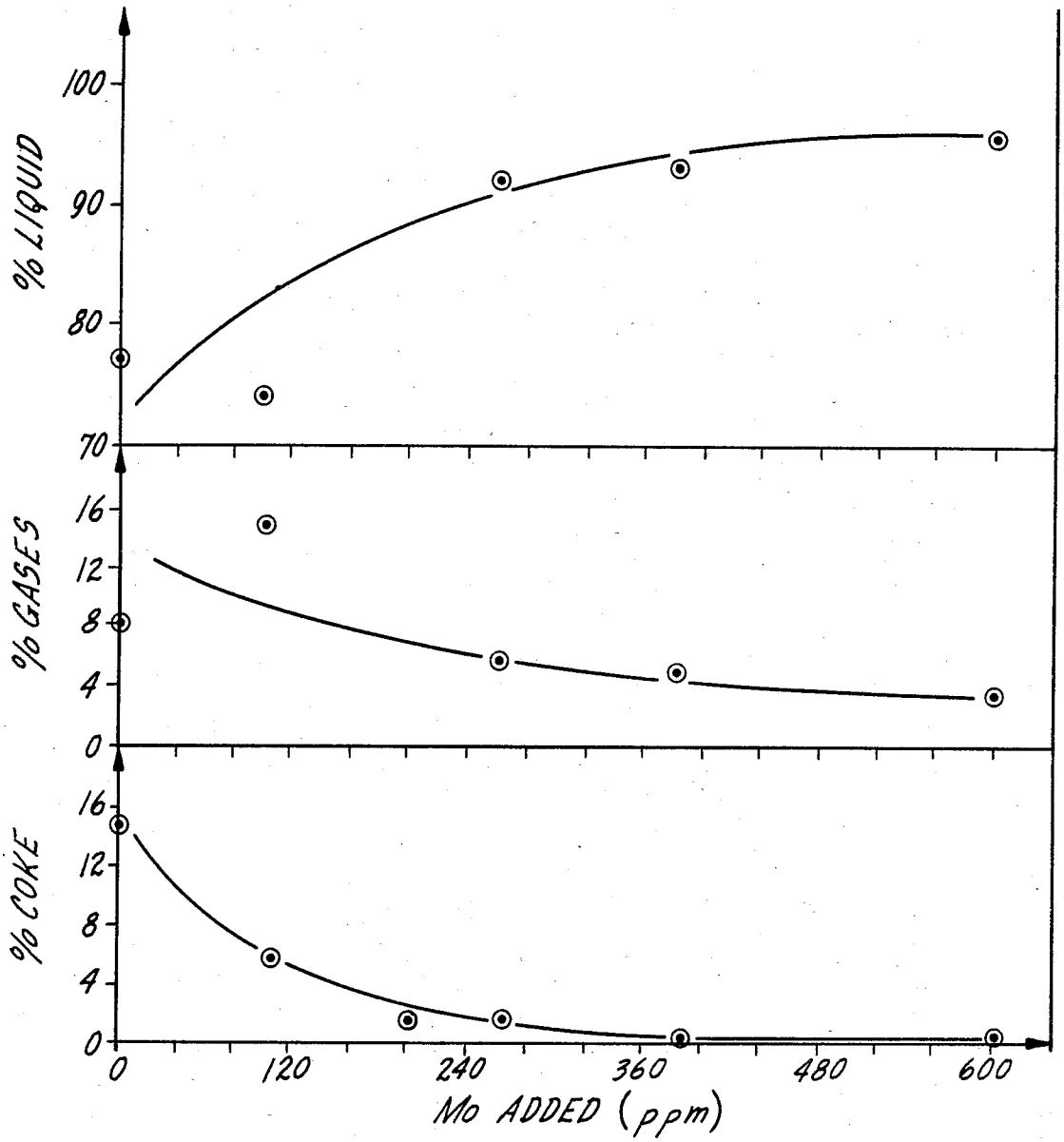
FIG. 2 is a graph showing the effect of molybdenum catalyst in the present process on the production of liquids, gases and coke.

The experimental results are shown in FIG. 2. The coke and gas were reduced considerably by the addition of molybdenum acetylacetonate as the soluble catalyst precursor.

EXAMPLE 2

Demonstration of the Efficiency of Soluble Metallic Compounds in Reducing the 500°+ C. Fraction of Heavy Crude A whole Morichal Crude was treated at 420° C. and 1800 psi for one hour in the presence of 265 ppm of molybdenum (added as molybdenum acetylacetonate). The experimental results are compiled in Table 2, below. As can be seen, the use of a metallic catalyst precursor compound reduces the 500° C.+ distilled fraction by 85 volume percent.

TABLE 2

| Effect of Molybdenum Acetylacetonate on Distillate Yield, Expressed as Percent by Volume | | | | | |
|---|---|---|---|---|---|
| Sample | $C_4$–375 °F. | 375–650 °F. | 650–930 °F. | Total, 930° F.− | 930° F.+ |
| Control Morichal Crude | 0.0 | 14.0 | 25.5 | 39.5 | 60.5 |
| Product at 420° C. (Blank Experiment) | 7.2 | 28.2 | 22.2 | 57.6 | 23.0 |
| Product at 420° C. with 265 ppm Mo | 8.0 | 51.1 | 29.2 | 88.3 | 10.0 |

EXAMPLE 3

Hydrothermal Treatment Followed by Hydrodemetallization and Hydrodesulfurization In this example whole Morichal Crude, whose characteristics appear in Table No. 3, below, was treated in a helicoidal reactor in the presence of molybdenum acetylacetonate, followed by a hydrodemetallization and hydrodesulfuration. The products obtained in each stage were subsequently subjected to a deasphalting. The experimental conditions are compiled in Table 4, below. The characteristics of the catalysts used are compiled in Table 5, below. The hydrogen:hydrocarbon ratio was 1000:1 $m^3(STP)/m^3$, and the linear velocity in the reactor for both the liquid and gas reactants was 0.1 cm/second. Characteristics of the obtained distillates are reported in Table 6, below.

TABLE 3

| Characteristics of the Products | | | | |
|---|---|---|---|---|
| Characteristics | Morichal Crude | Hydroconversion Stage | Hydroconversion Stage & Hydrotreatment Stage | Final Deasphalted Product (Deasphalted Oil) |
| °API | 11.8 | 15.5 | 18.7 | 21.3 |
| Sulfur, wt % | 2.85 | 1.88 | 0.74 | 0.43 |
| Vanadium, wppm[1] | 331 | — | 53.8 | 18.7 |
| Nickel, wppm | 89.1 | — | 41.9 | — |
| Nitrogen, wppm | 5,830 | 4,682 | — | — |
| Conradson Carbon, wt % | 12.0 | 9.18 | 6.79 | 4.00 |
| Asphaltenes, wt % | 9.0 | 6.17 | 3.21 | — |
| Kinematic Viscosity, cst: | | | | |
| at 140° F. | 600 | 77.22 | 37.3 | 19.6 |
| at 100° F. | 3,533 | 197.0 | 79.3 | — |
| Water, wt % | 0.1 | — | — | — |
| Bromine Number | | 14 | — | — |
| Carbon, wt % | 84.3 | 84.5 | 83.7 | 86.86 |
| Hydrogen, wt % | 10.5 | 11.14 | 11.24 | 11.97 |
| Consumption of $H_2$ (cubic feed/bbl) | | 500 | 550 | — |
| Distillation to TBP, ASTM-D2892: | | | | |
| 375° F. | — | 6.18 | 3.78 | 4 |
| 375–650° F. | 10.8 | 20.56 | 28.33 | 40 |
| 650–950° F. | 30.7 | 30.00 | 28.78 | 42 |
| 950° F.+ | 58.5 | 43.26 | 39.11 | 14 |

[1]parts per million, by weight.

TABLE 4

| Conditions of Reaction | | |
|---|---|---|
| Operating Conditions | Hydroconversion Stage (helicoidal reactor) | Hydrotreatment Stage |
| Catalyst | (100 wppm Additive) | Type AMN-5-32 + Type AMN-5-9[3] |
| Feedstock | Morichal Crude | HC Product[4] |
| Pressure, psi | 1500 | 1500 |
| Temperature of the THC Reactor[1], °C. | 480 | |
| Temperature of the Catalytic Bed, °C. | — | 400 |
| Feedstock + residue flow rate, cc/hour | 200 | 300 |
| $H_2$ flow, liters/minute | 2 | 5 |
| Ratio, $H_2$: (feedstock & residue), $m^3$ (STP)/$m^3$ | 600 | 1000 |
| LHSV[2], $h^{-1}$ | 2.5 | 1 |

[1]THC = Thermal Hydroconversion.
[2]Overall liquid hourly space velocity = 0.71 $h^{-1}$.
[3]AMN-5-32 and AMN-5-9 are catalysts produced as described herein.
[4]Stream from hydroconversion stage.

TABLE 5

| Characteristics of the Catalysts | | |
|---|---|---|
| Physical and Chemical Properties | Type AMN-5-32 (Hydrotreatment Stage) | TYPE AMN-5-9 (Hydrotreatment Stage) |
| $MoO_3$, wt % | 10.2 | 8.10 |
| NiO, wt % | — | 1.73 |
| CoO, wt % | 2.3 | — |
| Support | $Al_2O_3$ | $Al_2O_3$ |
| Pellet Size, inches | 1/32 | 1/32 |
| BET Area, $m^2$/gram | 271 | 177 |
| Pore volume, cc/gram | 0.84 | 0.67 |
| Pore diameter, A | 124 | 151 |
| Apparent Density, grams/cc | 0.87 | 1.10 |
| Real Density, grams/cc | 3.26 | 4.77 |
| Bed density, grams/cc | 0.68 | 0.58 |
| Bulk crushing strength of pellets, kg/pellet[1] | fragile | fragile |
| Bed crushing strength, kg/$cm^2$ | 11.60 | |
| Pore distribution, % $V_p$: Pore Diameter, A | | |
| 20–30 | 8.0 | 14.41 |
| 30–60 | 12.0 | 14.41 |
| 60–90 | 7.0 | 10.81 |
| 90–150 | 21.0 | 19.82 |
| 150–300 | 38.0 | 28.82 |
| 300–$10^3$ | 14.0 | 5.41 |
| >$10^3$ | 1.0 | 6.31 |

[1]Measured along the longitudinal axis of the pellet.

TABLE 6

| Characteristics of the Obtained Distillates | | |
|---|---|---|
| DISTRIBUTION OF SULFUR (% BY WEIGHT) IN EACH FRACTION | | |
| Fraction (°F.) | Product After Hydroconversion | Product After Hydrotreatment |
| $C_4$–375 | 0.16 | — |
| 375–650 | 0.70 | 0.05 |
| 650–950 | 1.39 | 0.42 |
| 950° F.+ | 2.71 | 1.10 |
| DISTRIBUTION OF VANADIUM (wppm) | | |
| Fraction (°F.) | Hydroconversion Product | Hydrotreatment Product |
| 650–950 | 10 | 10 |

TABLE 6-continued

| Characteristics of the Obtained Distillates | | |
|---|---|---|
| 950+ | 979.08 ± 10.4% | 118 |

CETANE INDEX FOR THE 375-650° F. FRACTIONS:
Hydroconversion Product = 40.0
Hydrotreatment Product = 37.5

As can be observed from Tables 3 and 6, a product of good quality was obtained after each stage. The product was even more improved when a deasphaltation stage was used. Table 3 in particular shows the beneficial effect on the invention on the conversion level of the 950° F.+ distillation fraction of the Morichal Crude, which fraction was reduced by 26 weight percent after the helicoidal reactor.

EXAMPLE 4

Treatment of Cerro Negro Crude

Figure 3:
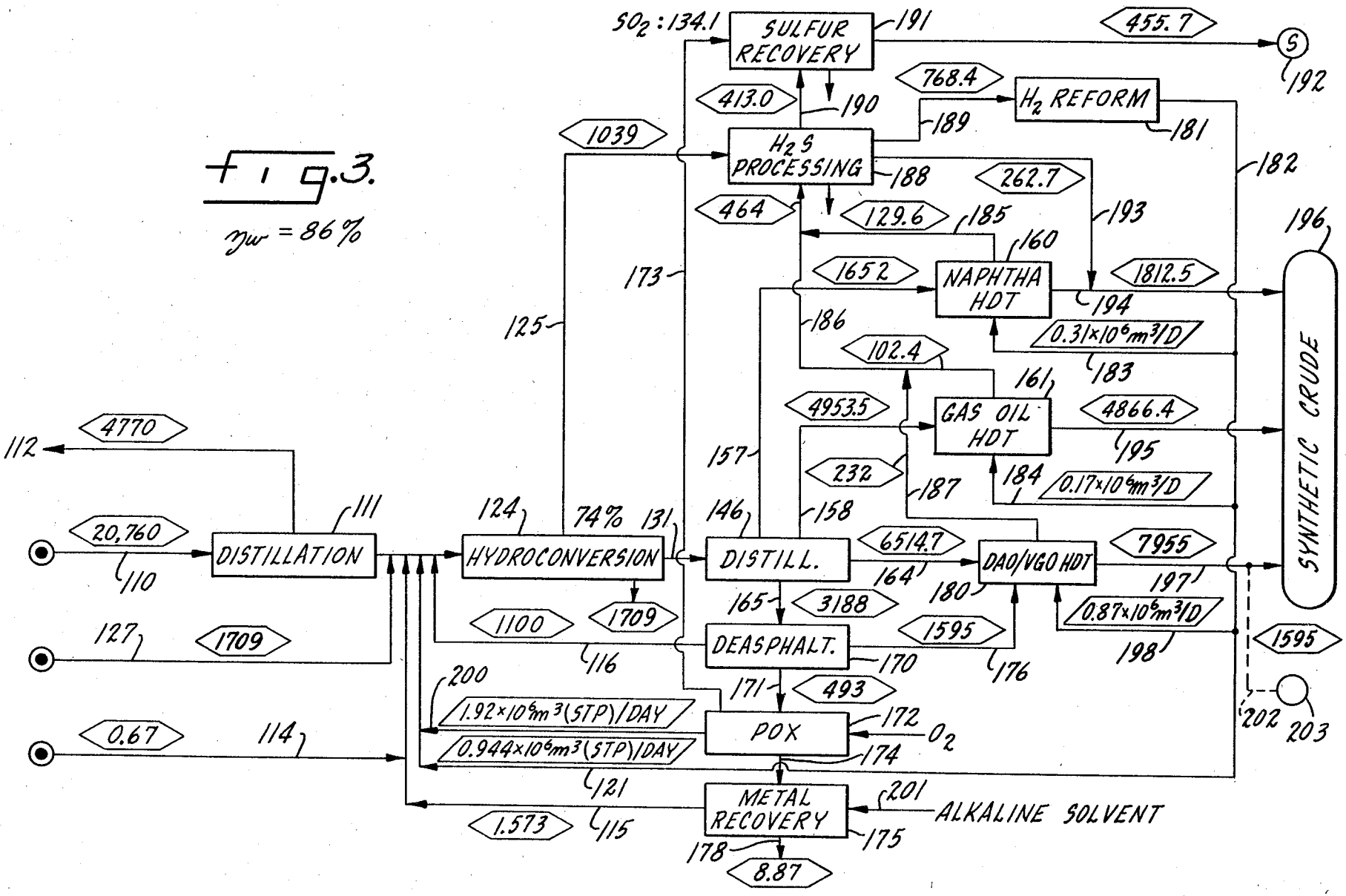
FIG. 3 is a diagram showing mass balance for the process of the present invention carried out as described in Example 4, below.

A process example was carried out as shown in FIGS. 1 and 3. FIG. 3 diagrammatically shows the mass balance for this example. The process steps and pathways are numbered to correspond with elements of FIG. 1 wherever possible. The quantity figures given are in metric tons per day unless otherwise noted.

Cerro Negro crude stream 110, whose properties are set out in Table 9, was subjected to a distillation at stage 111. After distilled oil stream 112 was stripped off, the crude was subjected to hydroconversion at stage 124 after incorporating several additives, consisting of water stream 127, fresh molybdenum compound stream 114, recovered molybdenum compound stream 115, recycled 500° C.+ vacuum residue stream 116, hydrogen stream 200 from partial oxidation, and hydrogen stream 121 from hydrogen reforming stage 181. Water was added in an amount equal to about 10% by weight of hydrocarbon feedstock to the hydroconversion stage. The vacuum residue was added so as to constitute about 7% by weight of the principal crude stream. Molybdenum compound streams 114 and 115 and active molybdenum metal present in vacuum residue stream 116 were added so as to provide molybdenum in concentrations of about 200 wppm and about 1080 wppm, respectively.

Hydroconversion stage 124 comprised a helicoidal reactor and a tubular reactor, in that order. The helicoidal reactor was operated at a temperature of about 490° C. and a pressure of about 103 kg/cm$^2$; hydrocarbon residence time was about 15 minutes. The tubular reactor was run in an ascending flow configuration at a temperature of about 440° C., a pressure of about 103 kg/cm$^2$, an $H_2$:feed ratio of about 1000 m$^3$(STP)/m$^3$ and a residence time of about 48 minutes. Reactant linear velocity was maintained at about 1.5 cm/sec. $H_2S$ produced in the hydroconversion stage 124 proceeded by path 125 to $H_2S$ processing step 188. The treated hydrocarbon meanwhile proceeded via pathway 131 to distillation stage 146. Additional data for the hydroconversion stage on an experimental scale are shown in Table 7, below.

TABLE 7

| Hydroconversion Conditions | |
|---|---|
| Feeding to the reactor: | |
| coil + soaker process rate, g/min | 0.87 |
| Molybdenum acetylacetonate, g/min | $1.7 \times 10^{-4}$ |
| Vacuum residue recycling, g/min | 0.086 |
| Residence times, coil/soaker reactors, hours | 0.25/0.8 |

The distillation stage, which comprised an atmospheric column and a vacuum distillation tower, also produced a naphtha fraction 157, a gas oil fraction 158, a vacuum gas oil fraction 164 and a 500° C.+ vacuum residue stream 165. The characteristics of the obtained vacuum gas oil are set out in Table 8, below.

TABLE 8

| Properties of Produced Vacuum Gas Oil | |
|---|---|
| Conradson Carbon, wt % | 0.20 |
| Sulfur, wt % | 1.9 |
| Total Nitrogen, wt % | 0.3 |
| Basic Nitrogen, wt % | 0.05 |
| Naphthenics, wt % of hydrocarbons | 30 |
| Aromatics, wt % of hydrocarbons | 40 |
| Paraffinics, wt % of hydrocarbons | 30 |
| Aromatic Carbon, ndm method | 16.5 |
| Specific gravity, °API | 19.5 |

A portion of vacuum residue stream 165 was mixed with gas oil and subjected to a continuous deasphaltation in unit 170 using isopentane as a solvent, operating at a temperature of 120° C., a pressure of 34.5 kg/cm$^2$ and a solvent:feed volumetric ratio of about 4:1. The resultant asphaltene stream 171 was burned in partial oxidation unit 172 to produce metal-containing ash stream 174, which was fed to metal recovery stage 175. At metal recovery stage 175, the ashes were treated first with sulfuric acid and then with an ammoniacal molybdenum solution 201, from which molybdenum acetylacetonate was prepared for recycling via pathway 115.

The deasphalted oil proceeded via pathway 176 to vacuum gas oil/deasphalted oil hydrotreatment stage 180. A portion of the hydrotreatment product from stage 180 can proceed optionally via path 202 to storage 203 in the field to be used to produce energy.

Vacuum gas oil 164 and deasphalted oil 176 were subjected to the same hydrotreatment stage as described in Example 3. The operating conditions were: temperature, 390° C.; pressure, 103 kg/cm$^2$; residence time, 1 hour. The characteristics of the deasphalted oil are shown in column 4 of Table 9, below.

TABLE 9

| Hydrocarbon Stream Properties | Cerro Negro Crude (8 ÅPI) Hydro-Conversion | | Vacuum Residue (VR) + Gas Oil (GO) Deasphaltation (44 wt % VR + 56 wt % GO) | |
|---|---|---|---|---|
| | Feed | Product | Feed | Product |
| Density at 15° C. | 1.013 | 0.93 | 0.964 | 0.950 |
| C, wt % | 84.0 | 84.55 | 85.0 | 84.3 |
| H, wt % | 10.1 | 10.65 | 10.9 | 11.3 |
| S, wt % | 3.4 | 2.2 | 5.0 | 1.35 |
| N, wt % | 0.6 | 0.4 | 0.854 | 0.18 |
| Asphaltenes, wt % | 10.0 | 2.1 | 4.66 | 1.0 |
| Conradson Carbon, wt % | 14 | 5.68 | 12.2 | 2.6 |
| Distillation fractions, vol % | | | | |
| Initial boiling point, °C. | 180 | 5 | 180 | 180 |
| 10% Volume | 280 | 140 | 250 | 240 |

TABLE 9-continued

| Hydrocarbon Stream Properties | Cerro Negro Crude (8 ÅPI) Hydro-Conversion | | Vacuum Residue (VR) + Gas Oil (GO) Deasphalt-ation (44 wt % VR + 56 wt % GO) | |
|---|---|---|---|---|
| | Feed | Product | Feed | Product |
| 20% Volume | 370 | 220 | 290 | 285 |
| 30% Volume | 430 | 280 | 310 | 305 |
| 40% Volume | — | 330 | 350 | 345 |
| 50% Volume | — | 358 | — | — |
| 60% Volume | — | 400 | — | — |
| 70% Volume | — | 455 | — | — |
| 80% Volume | — | 496 | — | — |
| % Yield, 500° C.- | 33% | 81.5% | 58.5% | 60% |
| Yield, wt %: | | | | |
| Liquid (Distill./ Residue) | (30/70) = 100 | (74.20/ 20.80) = 95 | —/20.80 | —/18.90 |
| Solids precip. by $C_7$ (asphaltenes) | — | — | — | 1.90% |
| Gases ($C_1$–$C_4$, $H_2S$, $NH_3$) | — | 6.5% | — | — |
| $H_2$ added, % by wt. | — | 1.5% | — | — |

Naphtha stream 157 and gas oil stream 158 emanating from distillation stage 146 were treated in respective hydrotreatment units 160 and 161. Each used a fixed bed unit utilizing conventional hydrotreating catalyst to complete the removal of nitrogen and sulfur and to stabilize the product. Make-up hydrogen for the units was supplied via pathways 183, 184 and 182 from hydrogen reformation stage 181. $H_2S$ produced from hydrotreatment stages 160, 161 and 180 proceeded via pathways 185, 186 and 187 to $H_2S$ processing stage 188, which in turn produced a $C_1$ to $C_4$ fraction, hydrogen, and sulfur, exiting via pathways 193, 189 and 190, respectively. The $C_1$ to $C_4$ fraction joined hydrotreated naphtha stream 194, hydrotreated gas oil 195 and hydrotreated vacuum gas oil and deasphalted oil 197 to form a high-quality synthetic crude 196. Hydrogen stream 189 from $H_2S$ recovery unit 188 was fed to $H_2$ reformation stage 181. Sulfur proceeded via pathway 190 to sulfur recovery unit 191, which in turn produced sulfur stream 192 as a by-product.

The produced synthetic crude had the properties set out in Table No. 10, below. Table 9 also sets out properties of the hydrocarbon stream before and after hydroconversion, the properties of a combined vacuum residue and gas oil before and after deasphaltation, and the properties of vacuum gas oil and a combined vacuum gas oil and deasphalted oil before and after hydrotreatment.

TABLE 10

| Properties of Obtained Synthetic Crude | | | |
|---|---|---|---|
| Distillation Yields, wt % Boiling point, °C. | Target | Product | Metric Tons/day |
| $C_4$–200 | 10 | 13.9 | 1812.5 |
| 200–300 | 25 | 37.32 | 4866.4 |
| 300–500 | 60 | 48.8 | 6360.0 |
| 500° C.+ | 25 | — | — |
| Total yield | | 13,637.4 metric tons/day | |
| Efficiency | | 0.82 | |
| Specific Gravity, °API | | 28° | - |
| Sulfur concentration, wt % | | 1.2 | |

EXAMPLE 5

Effect on Catalyst Precursor

A whole Morichal crude was subjected to a hydroconversion stage at a temperature of 420° C., a pressure of 1800 psig and a residence time of one hour together with one of a series of metallic compounds that served as thermally-decomposable catalyst precursors: Ammonium paramolybdate (APM), molybdenum acetylacetonate [$MoO_2(AA)_2$], iron acetylacetonate [$Fe(AA)_3$], chromium acetylacetonate [$Cr(AA)_3$], and vanadium acetylacetonate [$VO(AA)_2$]. For purposes of comparison, a whole Morichal crude was subjected to the same hydroconversion stage without any catalyst. The hydroconversion product was then separated into gas, liquid and coke fractions.

The experimental results are set out in Tables 11 and 12, below. The relative improvement (reduction) in coke formation and impurity concentration levels is readily apparent.

TABLE 11

| Effect of Injection of Metallic Compounds on the Yields of Liquid, Gases and Coke From a Hydroconversion Stage | | | | |
|---|---|---|---|---|
| Catalyst Precursor Compound | wppm, Catalyst Metal | wt % Coke | wt % Gases | wt % Liquids |
| Control Morichal Crude (No Catalyst) | 0 | 13.5 | 8.0 | 78.5 |
| Ammonium Para-molybdate | 489 | 3.4 | 10.4 | 85.9 |
| $MoO_2$ | 103 | 4.8 | 15.6 | 76.4 |
| $(AA)_2$ | 265 | 0.40 | 6.2 | 93.4 |
| | 383 | 0.30 | 6.1 | 93.6 |
| $Fe(AA)_3$ | 142 | 12.6 | 5.9 | 81.5 |
| | 265 | 6.0 | 11.9 | 82.1 |
| $Cr(AA)_3$ | 134 | 7.6 | 13.2 | 79.2 |
| | 265 | 4.5 | 6.1 | 89.4 |
| $VO(AA)_2$ | 265 | 4.2 | 13.8 | 81.9 |
| $Ni(AA)_2$ | 207 | 0.9 | 8.5 | 90.7 |
| $Co(AA)_2$ | 265 | 4.8 | 11.6 | 83.6 |

TABLE 12

| Characteristics of Hydroconversion Products Obtained With Different Metallic Compounds | | | | | | | |
|---|---|---|---|---|---|---|---|
| Catalyst Precursor Compound | wppm Catalyst Metal | Specific Gravity, °API | Visc. at 140° F. (CST) | Bromine Number | % HDS[1] | % HDV[2] | % Reduction of Conradson Carbon |
| Ammonium Paramolybdate | 489 | 17.0 | 12.3 | 19 | 14 | 25 | 11 |
| $MoO_2(AA)_2$ | 103 | 16.1 | 15.5 | 20 | 20 | 15 | 7 |
| | 265 | 16.9 | 19.2 | 21 | 22 | 30 | 10 |
| | 383 | 17.5 | 28.5 | 20 | 24 | 40 | 12 |
| $Fe(AA)_3$ | 142 | 16.9 | 11.6 | 23 | 22 | 40 | 15 |
| | 265 | 19.0 | 7.3 | 34 | 30 | 44 | 18 |
| $Cr(AA)_3$ | 134 | 16.7 | 13.7 | 26 | 25 | 41 | 10 |

TABLE 12-continued

| Characteristics of Hydroconversion Products Obtained With Different Metallic Compounds | | | | | | | |
|---|---|---|---|---|---|---|---|
| Catalyst Precursor Compound | wppm Catalyst Metal | Specific Gravity, °API | Visc. at 140° F. (CST) | Bromine Number | % HDS[1] | % HDV[2] | % Reduction of Conradson Carbon |
| | 265 | 16.9 | 10.1 | 31 | 28 | 45 | 11 |
| VO $(AA)_2$ | 265 | 16.4 | 19.1 | 27 | 27 | 43 | 12 |
| Ni $(AA)_2$ | 207 | 16.3 | 26.1 | 29 | 28 | 21 | 11 |
| Co $(AA)_2$ | 265 | 17.2 | 12.3 | 25 | 25 | 39 | 13 |

[1]hydrodesulfurization
[2]hydrodevanadization

Figure 4:
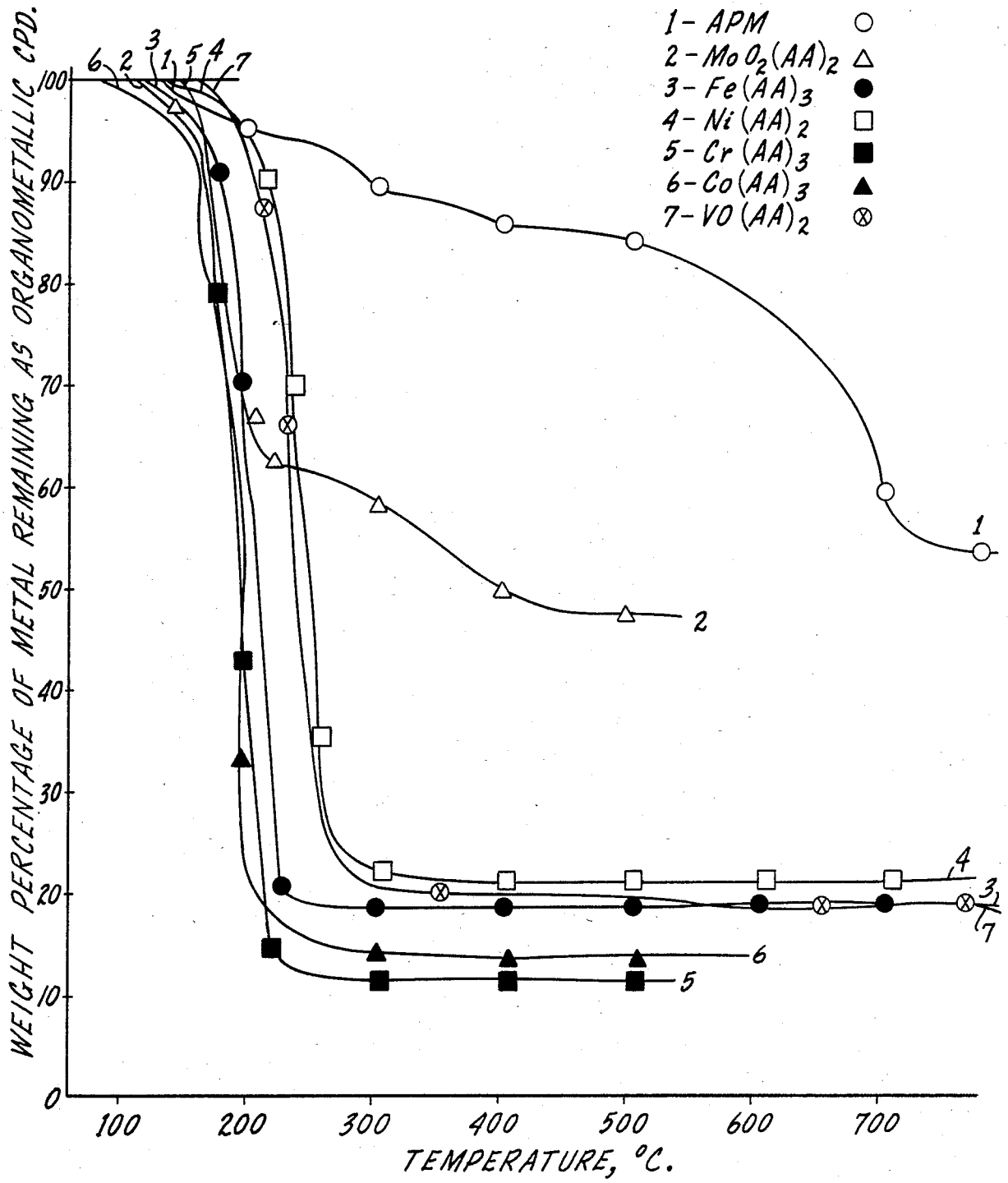
FIG. 4 graphically depicts the results of a thermogravimetric analysis of metallic catalyst precursor compounds employed in the process of this invention.

FIG. 4 shows how the various metallic compounds tested convert to other species upon elevation of temperature. In each case, the percentage of metallic compound with respect to total catalyst metal concentration decreases upon elevation of temperature. Dissociated metal later forms a metal-sulfur compound effective as an equilibrium catalyst upon localized injection of steam.

EXAMPLE 6

Effect of Pre-Heating Temperature on Viscosity

A continuous stream of hydrocarbon feedstock (Jobo Crude; 750 cst at 140° F.) admixed with hydrogen and at a pressure of about 2,000 psig was passed through a coil reactor in an up-flow manner and in a down-flow manner while the temperature in the reactor and the viscosity of the hydrocarbon feed stream were monitored. The experimental results are depicted graphically in FIG. 5.

Figure 5:
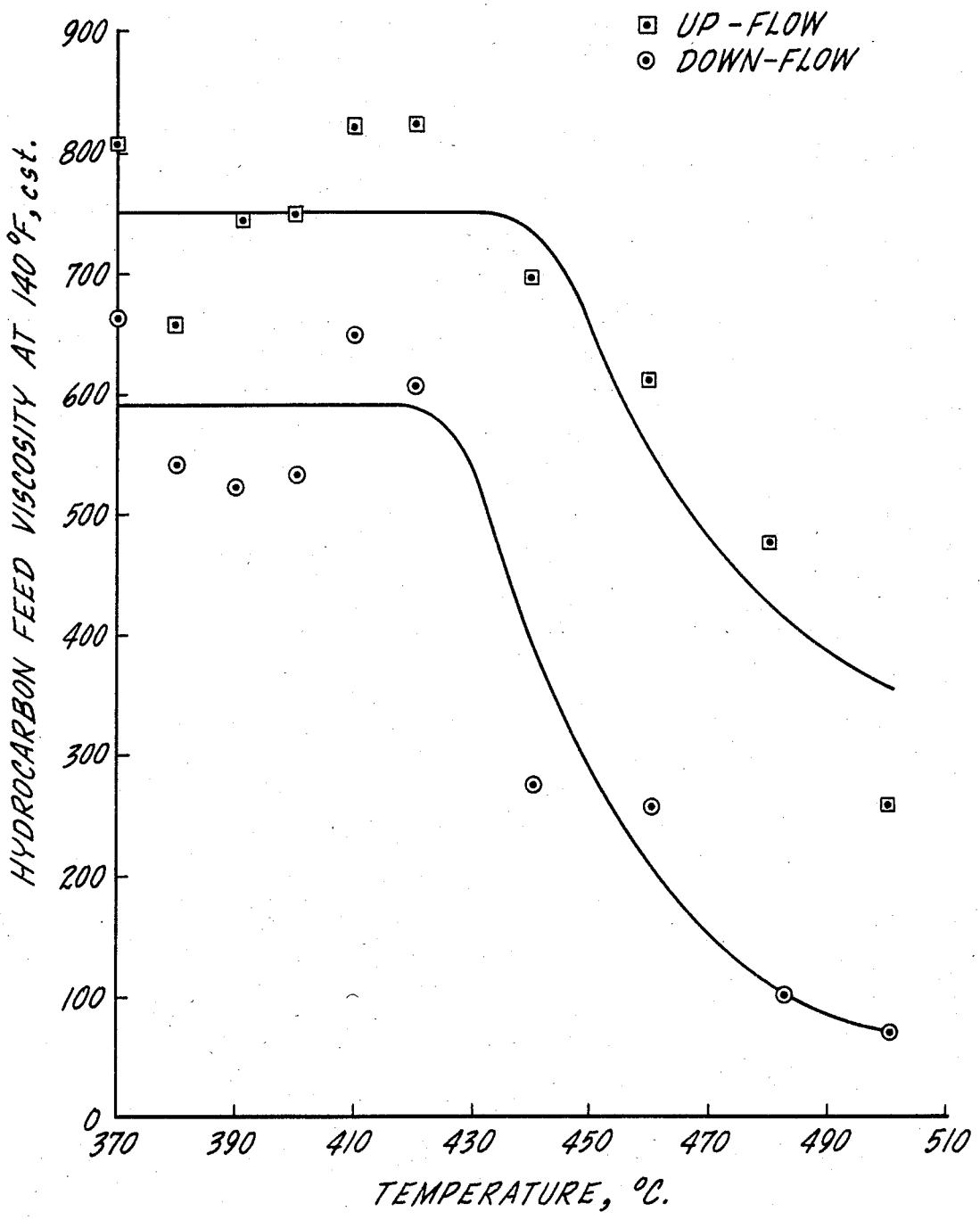
FIG. 5 is a graphical representation of hydrocarbon feed stream viscosity vs. temperature during preheating.

As can be readily seen from FIG. 5, substantially no visbreaking took place in the reactor until a temperature of about 420° C. was reached.

EXAMPLE 7

Effect of Water Addition During Pre-Heating

A semi-batch reactor (continuous gas flow, but discontinuous liquid phase flow) was operated with a feedstock having the properties shown in Table 13, below, was operated under the conditions shown in Table 14, below.

The experimental results are compiled in Table 15, below.

TABLE 13

| Feedstock Properties | |
|---|---|
| Properties | Cerro Negro Residuum 200° C.+ |
| API Gravity | 8.3 |
| Asphaltenes, wt % | 11.41 |
| Conradson carbon, wt % | 14.95 |
| Viscosity at 140° F., cst. | 5482.6 |
| Viscosity at 210° F., cst. | 343.67 |
| Sulphur, wt % | 3.75 |
| Vanadium, wppm | 408.59 ± 2.6% |

TABLE 14

| Effect of Additives on the Hydroconversion of Heavy Crudes. Experimental Conditions | | | | | | | |
|---|---|---|---|---|---|---|---|
| Feedstock (1300 g) | Additives | Concentration | Pressure (psig) | Temp. (°C.) | $FH_2$ (1/min) | Va (rpm) | Tr (min) |
| CCN | $H_2O$ | 10 wt % | 1800 | 430 | 4.65 | 900 | 60 |
| CCN | $(AA)_2$ $MoO_2$ | 100 wppm | 1800 | 430 | 4.65 | 900 | 60 |
| CCN | $(AA)_2$ $MoO_2$ | 200 wppm | 1800 | 430 | 4.65 | 900 | 60 |
| CCN | $H_2O/(AA)_2$ $MoO_2$ | 10 wt %/100 wppm | 1800 | 430 | 4.65 | | 60 |
| CCN | $H_2O/(AA)_2$ $MoO_2$ | 10 wt %/200 wppm | 1800 | 430 | 4.65 | | 60 |

CCN = Cerro Negro Residuum 200° C.+
$FH_2$ = Hydrogen flow
Va = Agitation rate
Tr = Residence time
$(AA)_2MoO_2$ = Molybdenum acetylacetonate

TABLE 15

| Effect of Additives on the Hydroconversion of Heavy Crudes. Results | | | | |
|---|---|---|---|---|
| Additives | °API | Vanadium (ppm) | Sulphur (wt %) | Vicsocity 140° F. cst |
| $H_2O$ 10 wt % | 15.2 | 299.45 | 2.87 | 16.3 |
| $(AA)_2MoO_2$ 100 wppm | 17.8 | 251.10 | 2.63 | 11.98 |
| $(AA)_2MoO_2$ 200 wppm | 18 | 210.44 | 2.42 | 29.94 |
| $H_2O$ 10 wt %/$(AA)_2$ $MoO_2$ 100 wppm | 18.3 | 222.83 | 2.86 | 17.31 |
| $H_2O$ 10 wt %/$(AA)_2$ $MoO_2$ 200 wppm | 19.1 | 86.79 | 2.56 | 4.8 |

From the results of Table 15 the beneficial results attained by the introduction of water are readily apparent. Improved hydrodemetallization as well as an improvement in viscosity are obtained.

EXAMPLE 8

Effect of Water Addition on Coke Formation

A semi-batch reactor was operated with a feed stock having the properties shown in Table 13, above, with and without water addition, and in the presence of hydrogen but without catalyst. The reactor pressure was 1800 psig, and the reactor temperature was 430° C. The hydrogen flow rate was 4.65 liters per minute, and the residence time was 60 minutes.

The experimental results are compiled in Table 16, below.

TABLE 16

| Feed | Coke Formation and Yields in the Presence of Water | |
|---|---|---|
| | Coke, wt % | Liquid, wt % |
| Crude only | 11.3 | 72.75 |
| Crude and 10 wt % $H_2O$ | 7.4 | 80.86 |

The foregoing data demonstrate that the addition of water substantially reduces coke formation and enhances liquid yield during hydroconversion.

We claim:

1. A thermal hydroconversion process for a hydrocarbon feedstock containing asphaltenes and metals which comprises the steps of (a) combining said feedstock with water, with a metallic catalyst precursor soluble in the feedstock and containing a metal catalyst which is a member of the group consisting of Groups IVB, VB, VIB, VIIB and VIII of the Periodic Table of Elements, and with a liquid recycle stream containing said metal catalyst in an amount of about 400 to about 15000 parts of said metal catalyst per million parts by weight of said recycle stream to produce a liquid admixture; said water being added to the resulting liquid admixture in an amount of about 0.1 to about 20 volume percent, based on the volume of the feedstock, and said metallic catalyst precursor being present in an amount providing about 50 to about 1000 parts of said metal catalyst per million parts by weight of said feedstock;

(b) pre-heating the resulting admixture to a temperature of at least about 230° C. but no more than about 420° C. for a time period sufficient to effect decomposition of the metallic catalyst precursor present;

(c) introducing hydrogen into the pre-heated admixture and subjecting the resulting mixture to thermal hydroconversion at a temperature of about 420° C. to about 540° C. and at a pressure of about 20 to about 250 atmospheres for a time period sufficient to provide an upgraded hydrocarbon mixture, and while maintaining a liquid water concentration in the resulting mixture of about 2 to about 25 percent by volume, based on the volume of the feedstock;

(d) fractionating the upgraded hydrocarbon mixture to produce at least one vapor phase fraction and a residue fraction containing said metal catalyst; and (e) recycling at least a portion of the residue fraction to step (a), above.

2. The process in accordance with claim 1 wherein the metallic catalyst precursor is molybdenum acetylacetonate and said metal catalyst is molybdenum.

3. The process in accordance with claim 1 wherein the metallic catalyst precursor is ammonium paramolybdate and said metal catalyst is molybdenum.

4. The process in accordance with claim 1 wherein the metallic catalyst precursor is iron acetylacetonate and said metal catalyst is iron.

5. The process in accordance with claim 1 wherein the metallic catalyst precursor is chromium acetylacetonate and said metal catalyst is chromium.

6. The process in accordance with claim 1 wherein the metallic catalyst precursor is vanadium oxide acetylacetonate and said metal catalyst is vanadium.

7. The process in accordance with claim 1 wherein the metallic catalyst precursor is nickel acetylacetonate and the metal catalyst is nickel.

8. The process in accordance with claim 1 wherein the metallic catalyst precursor is cobalt acetylacetonate and the metal catalyst is cobalt.

9. The process in accordance with claim 1 wherein the thermal hydroconversion is carried out at a hydrogen-to-hydrocarbon feedstock volumetric ratio of about 100 to about 2,000, the volume of hydrogen taken at standard conditions, and in two stages, with the first stage being at about 440° C. to about 500° C. and at a pressure of about 50 to about 150 atmospheres and the second stage being at a temperature of about 430° C. to about 460° C. and at a pressure of about 20 to about 200 atmospheres.

10. The process in accordance with claim 9 wherein the first stage is carried out in a helicoidal reactor heating the incoming pre-heated admixture at a variable heat transfer rate beginning at about 350 Kcal/h $m^2$ and increasing to about 10,000 Kcal/h $m^2$, and wherein the second stage is carried out in a soaker reactor.

11. The process in accordance with claim 10 wherein steam is injected periodically into the helicoidal reactor in an amount sufficient to reduce coke formation within the helicoidal reactor.

12. The process in accordance with claim 1 wherein that portion of the residue fraction not recycled to step (a) is subjected to deasphaltation.

13. The process in accordance with claim 12 wherein the deasphaltation is carried out at a temperature in the range of about 100° C. to about 170° C. and at a pressure in the range of about 14 to about 50 atmospheres.

14. The process in accordance with claim 12 wherein the deasphalted portion of the residue fraction is hydrotreated in a catalytic bed at a temperature of about 350° C. to about 440° C., at a pressure of about 20 to about 200 atmospheres, and at a hydrogen-to-hydrocarbon volumetric ratio of about 100 to about 2,000, the volume of hydrogen taken at standard conditions.

15. The process in accordance with claim 12 wherein the deasphalted portion of the residue fraction is hydrotreated in a catalytic bed at a temperature of about 370° C. to about 430° C., at a pressure of about 50 to about 150 atmospheres, and at a hydrogen-to-hydrocarbon volumetric ratio of about 100 to about 1,500, the volume of hydrogen taken at standard conditions.

16. The process in accordance with claim 1 wherein the combined liquid recycle stream constitutes about 0.1 to about 20 percent by volume of the hydrocarbon feedstock.

17. The process in accordance with claim 1 wherein the combined liquid recycle stream constitutes about 5 to about 15 percent by volume of the hydrocarbon feedstock.

18. The process in accordance with claim 1 wherein water is present in the resulting liquid admixture in an amount of about 5 to about 15 volume percent, based on the volume of the feedstock.

* * * * *